US007825613B2

(12) United States Patent
Ye et al.

(10) Patent No.: US 7,825,613 B2
(45) Date of Patent: Nov. 2, 2010

(54) BACKLIGHT ASSEMBLY AND DISPLAY DEVICE HAVING THE SAME

(75) Inventors: Byoung-Dae Ye, Yongin-si (KR); Sang-Hoon Lee, Yongin-si (KR); Ho-Sik Shin, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 459 days.

(21) Appl. No.: 11/875,394

(22) Filed: Oct. 19, 2007

(65) Prior Publication Data

US 2008/0094006 A1 Apr. 24, 2008

(30) Foreign Application Priority Data

Oct. 19, 2006 (KR) ..... 10-2006-0101884

(51) Int. Cl.
*H05B 37/00* (2006.01)

(52) U.S. Cl. ..... 315/312; 315/318; 315/291; 315/169.1; 345/102; 345/82

(58) Field of Classification Search ..... 315/291, 315/224, 312, 307, 169.1–169.3, 294, 295, 315/362, 360, DIG. 4, 318; 345/39, 42, 52, 345/77, 82, 87, 89, 109, 102
See application file for complete search history.

(56) References Cited

U.S. PATENT DOCUMENTS 6,507,159 B2 * 1/2003 Muthu ..... 315/307
6,628,357 B1 * 9/2003 Maeda et al. ..... 349/113
7,220,039 B2 * 5/2007 Ahn et al. ..... 362/612
7,242,383 B2 * 7/2007 Zavracky et al. ..... 345/102
7,276,863 B2 * 10/2007 Lee et al. ..... 315/307
7,511,435 B2 * 3/2009 Ye et al. ..... 315/291
7,632,000 B2 * 12/2009 Han et al. ..... 362/561

* cited by examiner

*Primary Examiner*—Haissa Philogene
(74) *Attorney, Agent, or Firm*—H.C. Park & Associates, PLC

(57) ABSTRACT

A backlight assembly includes a plurality of unit blocks to emit light. Each unit block includes a light-emitting part and a driving part. The light-emitting part includes at least two red light-emitting diodes (LEDs), two green LEDs, and two blue LEDs. The driving part includes a red LED-driving element that provides the red LEDs with a driving voltage, a green LED-driving element that provides the green LEDs with a driving voltage, and a blue LED-driving element that provides the blue LEDs with a driving voltage. LEDs may be driven together in a group, or may be driven individually to sequentially emit red light, green light, and blue light so a color filter is not included in a display panel having the backlight assembly. A driving element is connected to the LEDs to reduce manufacturing costs for the driving element circuits, thereby reducing manufacturing costs of the backlight assembly.

20 Claims, 8 Drawing Sheets

BACKLIGHT ASSEMBLY AND DISPLAY DEVICE HAVING THE SAME

CROSS-REFERENCE TO RELATED APPLICATIONS

This application claims priority from and the benefit of Korean Patent Application No. 10-2006-0101884, filed on Oct. 19, 2006, which is hereby incorporated by reference for all purposes as if fully set forth herein.

BACKGROUND OF THE INVENTION

1. Field of the Invention

The present invention relates to a backlight assembly and a display device having the backlight assembly. More particularly, the present invention relates to a backlight assembly capable of reducing manufacturing costs thereof, and a display device having the backlight assembly.

2. Discussion of the Background

A liquid crystal display (LCD) device displays an image by using a liquid crystal material that has optical characteristics such as anisotropic refractivity as well as electrical characteristics such as an anisotropic dielectric constant. The LCD device has a number of advantageous characteristics compared to other display devices, such as cathode ray tube (CRT) devices and plasma display panel (PDP) devices. For example, LCD devices may be thinner and may be driven using a relatively low driving voltage, thereby consuming less power than other device types. As a result, LCD devices are commonly used for many different purposes.

However, LCD devices do not generate light to display an image. Therefore, an LCD device includes an LCD panel for displaying an image by using light transmittance of liquid crystals and a backlight assembly under the LCD panel to supply the LCD panel with light.

The LCD panel includes a first substrate having a plurality of thin-film transistors (TFTs) arranged to correspond to a plurality of unit pixels, a second substrate having a color filter arranged thereon, and a liquid crystal layer interposed between the first substrate and the second substrate. The color filter is arranged to correspond to the unit pixels, and includes red color filters, green color filters, and blue color filters.

The backlight assembly includes a light source that generates light to pass through the liquid crystal layer to display an image. The backlight assembly typically uses a cold cathode fluorescent lamp (CCFL), a flat fluorescent lamp (FFL), or a light-emitting diode (LED) as the light source.

The LED has become popular recently because the LED has a high luminance and consumes relatively less power than other types of light sources. When used as a light source for a backlight assembly, the LEDs may be disposed on a driving substrate and may be manufactured to have a chip shape. The LEDs include a red LED, a green LED, and a blue LED.

Recently, a local dimming method has been developed. In the local dimming method, some LEDs may emit light while other LEDs may not emit light during a frame. In order to drive the LEDs using the local dimming method, the number of the LEDs in the backlight assembly may be equal to the number of driving elements. Specifically, each LED may be connected to a driving element so that the driving elements individually activate each LED to control the light emission from the backlight assembly.

Therefore, a backlight assembly operated by the local dimming method has a number of driving elements equal to the number of LEDs. This increases the cost to manufacture a circuit for the backlight assembly operated by the local dimming method. Furthermore, the circuit for the backlight assembly operated by the local dimming method may be complicated.

SUMMARY OF THE INVENTION

This invention provides a backlight assembly capable of reducing manufacturing costs thereof.

The present invention also provides a display device having the backlight assembly.

Additional features of the invention will be set forth in the description which follows, and in part will be apparent from the description, or may be learned by practice of the invention.

The present invention discloses a backlight assembly including a plurality of unit blocks to emit light. Each unit block includes a light-emitting part and a driving part. The light-emitting part includes two red light-emitting diodes (LEDs), two green LEDs and two blue LEDs. The driving part includes a red LED-driving element to provide the two red LEDs with a driving voltage, a green LED-driving element to provide the two green LEDs with the driving voltage, and a blue LED-driving element to provide the two blue LEDs with the driving voltage.

The present invention also discloses a display device including a backlight assembly having a plurality of unit blocks to emit light and a display panel disposed on the backlight assembly to display an image.

Each unit block includes a light-emitting part and a driving part. The light-emitting part includes two red LEDs, two green LEDs and two blue LEDs. The driving part includes a red LED-driving element to provide the two red LEDs with a driving voltage, a green LED-driving element to provide the two green LEDs with a driving voltage, and a blue LED-driving element to provide the two blue LEDs with a driving voltage.

The present invention also discloses a backlight assembly including a plurality of unit blocks to emit light. Each unit block includes a light-emitting part, a driving part, and a light-emitting control part. The light-emitting part includes a first light-emitting group comprises a first red LED, a first green LED, and a first blue LED, a second light-emitting group comprising a second red LED, a second green LED, and a second blue LED, and a third light-emitting group comprising a third red LED, a third green LED, and a third blue LED. The driving part includes a red LED-driving element connected to the first red LED, the second red LED, and the third red LED, a green LED-driving element connected to the first green LED, the second green LED, and the third green LED, and a blue LED-driving element connected to the first blue LED, the second blue LED, and the third blue LED. The light-emitting control part includes a first light-emitting control transistor connected to the first light-emitting group to individually control the first light-emitting group, a second light-emitting control transistor connected to the second light-emitting group to individually control the second light emitting group, and a third light-emitting control transistor connected to the third light-emitting group to individually control the third light emitting group.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
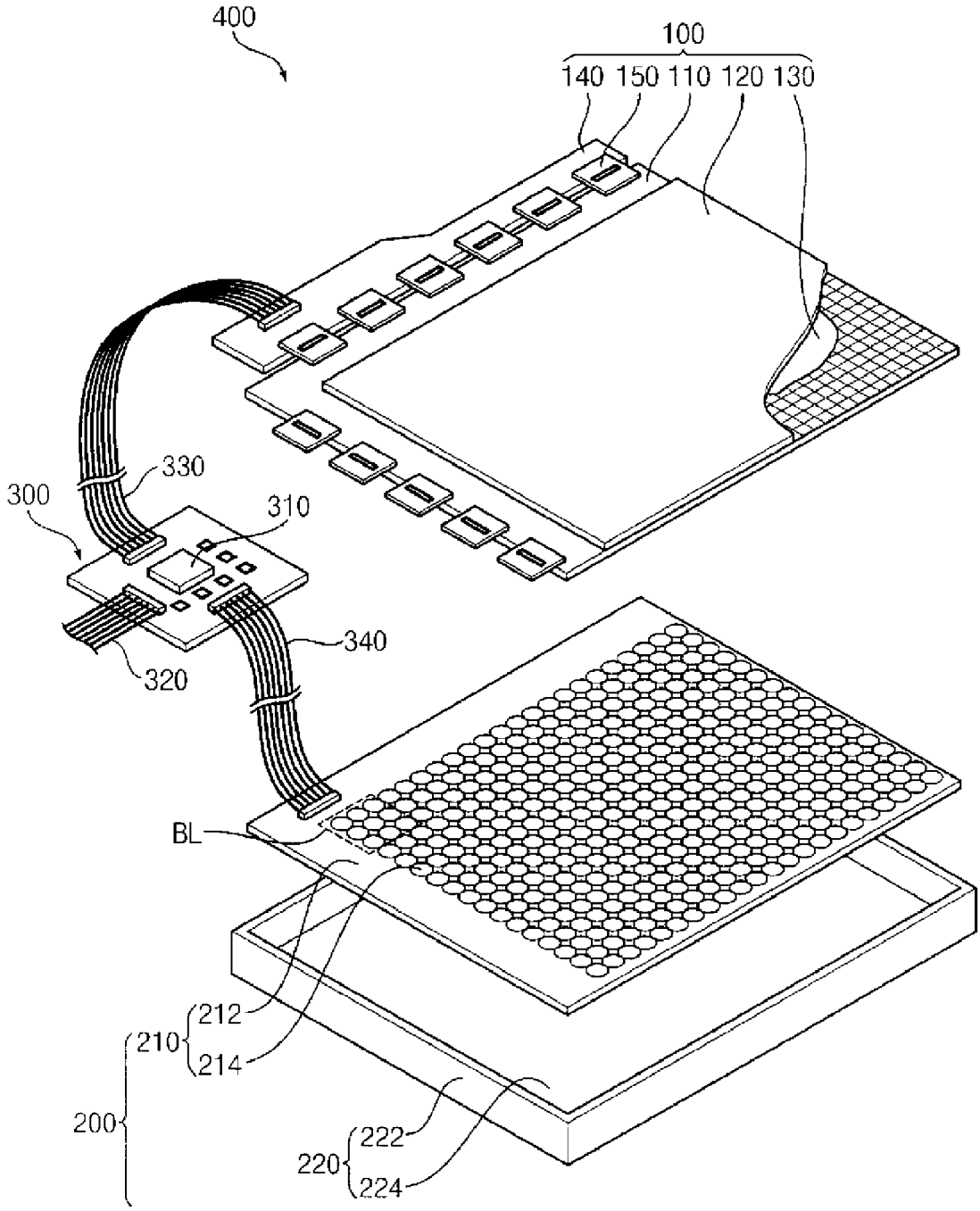
FIG. 1 is an exploded perspective view illustrating a display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer, mechanically and/or electrically, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Exemplary Embodiment 1

Display Device

Figure 2:
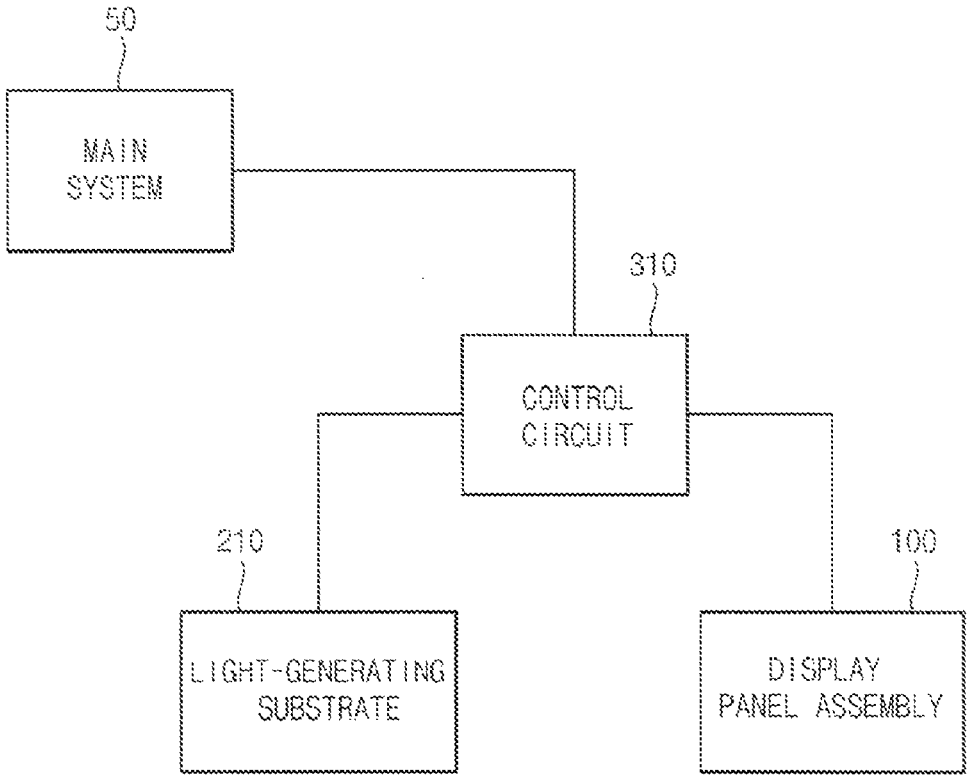
FIG. 2 is a block diagram illustrating the display device shown in FIG. 1.

FIG. 1 is an exploded perspective view illustrating a display device according to an exemplary embodiment of the present invention. FIG. 2 is a block diagram illustrating the display device shown in FIG. 1. Referring to FIG. 1 and FIG. 2, a display device 400 according to an exemplary embodiment of the present invention includes a display panel assembly 100, a backlight assembly 200 and a control unit 300, and displays an image.

The display panel assembly 100 includes a first substrate 110, a second substrate 120, a liquid crystal layer 130, a printed circuit board (PCB) 140, and a flexible printed circuit board (FPCB) 150.

The first substrate 110 includes pixel electrodes arranged in a matrix shape. Each pixel electrode may be formed of an optically transparent and electrically conductive material. The first substrate 110 also includes thin-film transistors (TFTs) that apply a driving voltage to each of the pixel electrodes, and signal lines that activate the TFTs.

The signal lines include gate lines and data lines. The gate lines and the data lines cross with each other to define unit pixels. Each unit pixel includes a TFT and a pixel electrode.

The second substrate 120 opposes the first substrate 110. The second substrate 120 includes a common electrode formed of an optically transparent and electrically conductive material disposed thereon. The second substrate 120 may include color filters. A color filter may be arranged to correspond to a unit pixel.

The liquid crystal layer 130 is interposed between the first substrate 110 and the second substrate 120. When an electric field generated between a pixel electrode and the common electrode is applied to the liquid crystal layer 130, liquid crystal molecules of the liquid crystal layer 130 are aligned according to the magnitude and direction of the electric field. The alignment of the liquid crystal molecules controls the transmittance of light through the liquid crystal layer 130 to thereby display images on the display device 400.

The PCB 140 changes a first image control signal that is provided from a control circuit 310 into a second image control signal in order to display an image. For example, the first image control signal may includes a vertical synchronizing signal (Vsync), a horizontal synchronizing signal (Hsync), a main clock signal (MCLK), and a data enable signal (DE). The vertical synchronizing signal (Vsync) represents a time required for displaying one frame. The horizontal synchronizing signal (Hsync) represents a time required for displaying one line of the frame. Thus, the horizontal synchronizing signal includes pulses corresponding to the number of pixels included in one line. The data enable signal (DE) represents a time required for supplying the pixel with data. The second image control signal may include a load signal, a horizontal start signal, a polarity control signal, etc. Because the FPCB 150 is flexible and may be bent, the PCB 140 may be disposed behind the first substrate 110. The PCB 140 may include a data PCB and a gate PCB. In this exemplary embodiment, additional signal lines may be arranged in the first substrate 110 and the FPCB 150 so that the gate PCB is not included in the display device 400.

The FPCB 150 is connected to the PCB 140 and the first substrate 110 to provide the first substrate 110 with the second image control signal that is generated by the PCB 140. The FPCB 150 may include a driving chip that changes the second image control signal into a driving signal to drive the TFTs. The FPCB 150 may include, for example, a tape carrier package (TCP) and a chip-on-film (COF), and the driving chip may be disposed on the first substrate 110, not on the FPCB 150.

The display panel assembly 100 according to the present exemplary embodiment may include an optically compensated bend (OCB) mode liquid crystal layer 130, which has a high response speed.

The backlight assembly 200 is disposed behind the display panel assembly 100 to provide the display panel assembly 100 with light. The backlight assembly 200 includes a light-generating substrate 210 that emits light and a receiving container 220 that receives the light-generating substrate 210.

The light-generating substrate 210 emits light and provides the light to the display panel assembly 100. The light-generating substrate 210 includes a driving substrate 212 and a light-emitting unit 214.

The driving substrate 212 includes a control line (not shown) for controlling the light-emitting unit 214 and a voltage line (not shown) for providing the light-emitting unit 214 with a voltage.

The light-emitting unit 214 is disposed on the driving substrate 212 to emit light. The control line is connected to the light-emitting unit 214 to control the light-emitting unit 214, and the voltage line is connected to the light-emitting unit 214 to provide the light-emitting unit 214 with a voltage. The light-emitting unit 214 includes LEDs to generate the light that is emitted.

The receiving container 220 includes a bottom part 224 and a side part 222 extending from an edge portion of the bottom part 224 to form a receiving space. The receiving container 220 may receive the light-generating substrate 210. The receiving container 220 may also receive the display panel assembly 100.

The backlight assembly 200 may include an optical sheet (not shown) disposed between the display panel assembly 100 and the light-generating substrate 210. The optical sheet may include a diffusing plate to enhance the uniformity of light emitted from the display device 400, and/or one or more prism sheets to increase the luminance of light emitted from the display device 400.

The control unit 300 is connected to the display panel assembly 100 and the light-generating substrate 210 to control the display panel assembly 100 and the light-generating substrate 210. For example, the control unit 300 may include the control circuit 310, a first connector 320, a second connector 330, and a third connector 340.

Referring to FIG. 1 and FIG. 2, the control circuit 310 is connected to a main system 50 through the first connector 320, and is connected to the PCB 140 of the display panel assembly 100 through the second connector 330. The control circuit 310 is connected to the light-generating substrate 210 through the third connector 340.

The control circuit 310 receives a circuit control signal from the main system 50, and generates the first image control signal and a light source control signal. The first image control signal is applied to the display panel assembly 100 to individually drive each TFT of the unit pixels. The light source control signal is applied to the light-generating substrate 210 to individually drive each LED of the light-emitting unit 214.

Figure 3:
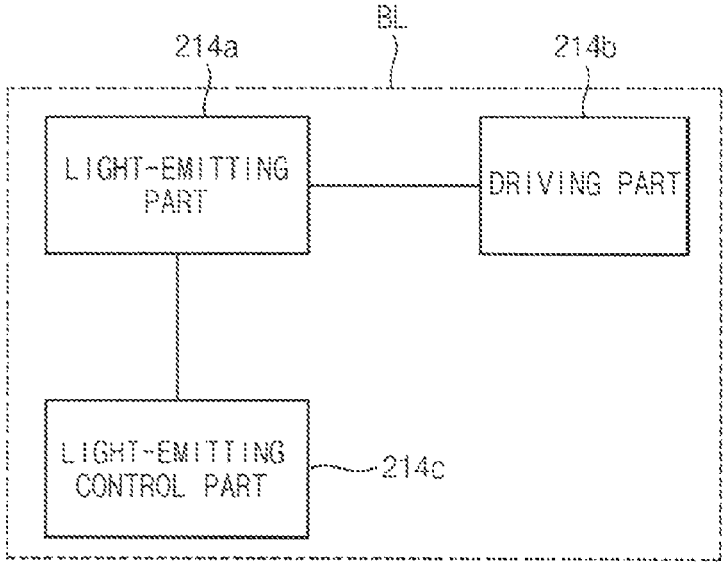
FIG. 3 is a schematic diagram illustrating a unit block of the backlight assembly shown in FIG. 1.
Figure 4:
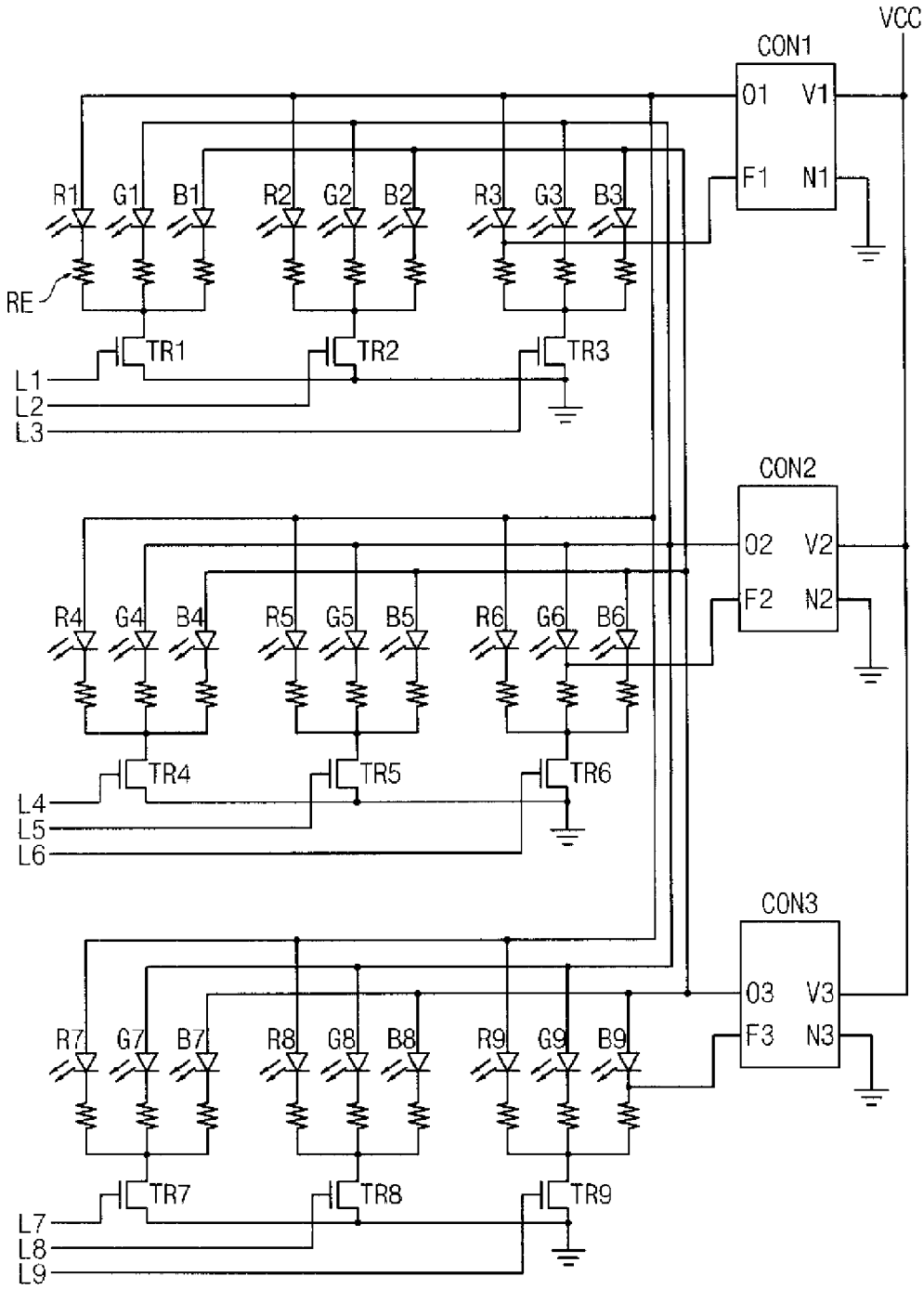
FIG. 4 is a schematic circuit diagram of the unit block shown in FIG. 3 according to an exemplary embodiment of the present invention.
Figure 5:
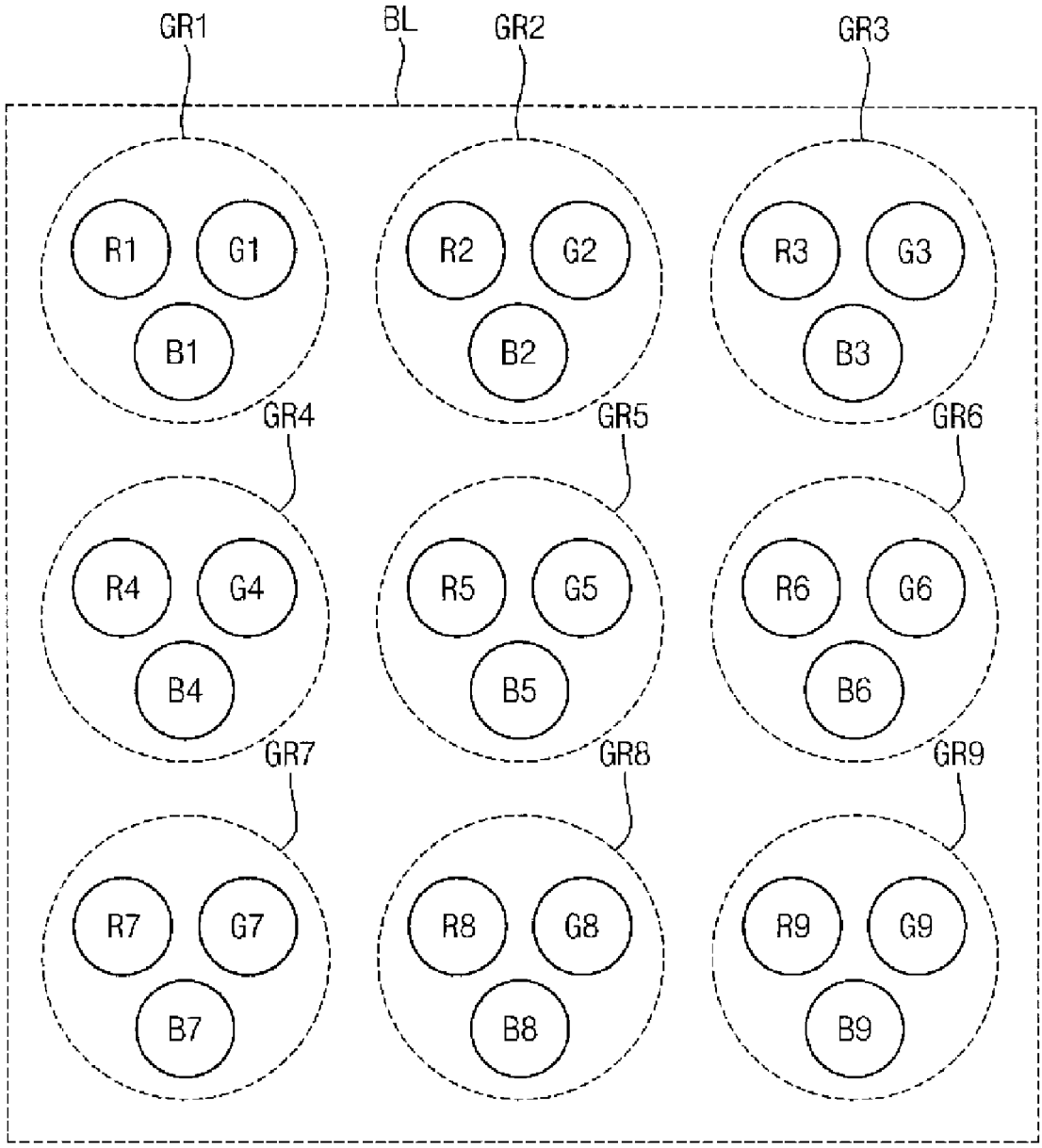
FIG. 5 is a diagram illustrating groups of the LEDs shown in FIG. 4.

FIG. 3 is a schematic diagram illustrating a unit block of the backlight assembly shown in FIG. 1. FIG. 4 is a schematic circuit diagram of the unit block shown in FIG. 3 according to an exemplary embodiment of the present invention. FIG. 5 is a diagram illustrating groups of the LEDs shown in FIG. 4.

Referring to FIG. 1, FIG. 3, and FIG. 4, a light-emitting unit 214 according to the present exemplary embodiment is disposed on the driving substrate 212 to emit light. The light-emitting unit 214 is divided into a plurality of unit blocks BL. As shown in FIG. 3, each unit block BL includes a light-emitting part 214*a* to emit light, a driving part 214*b* to provide the light-emitting part 214*a* with a driving voltage, and a light-emitting control part 214*c* to control the light-emitting part 214*a*.

The light-emitting part 214*a* may include at least two red LEDs, at least two green LEDs, and at least two blue LEDs.

Referring now to FIG. 4, the driving part 214*b* includes a red LED-driving element CON1 that provides the red LEDs with a driving voltage, a green LED-driving element CON2 that provides the green LEDs with a driving voltage, and a blue LED-driving element CON3 that provides the blue LEDs with a driving voltage.

The light-emitting control part 214*c* is connected to the light-emitting part 214*a*, thereby individually activating the light-emitting part 214*a*.

Referring to FIG. 4 and FIG. 5, the light-emitting part 214*a* may include nine red LEDs R1, R2, R3, R4, R5, R6, R7, R8, and R9, nine green LEDs G1, G2, G3, G4, G5, G6, G7, G8, and G9, and nine blue LEDs B1, B2, B3, B4, B5, B6, B7, B8, and B9.

Referring to FIG. 5, the light-emitting part 214*a* may be divided into nine light-emitting groups GR1, GR2, GR3, GR4, GR5, GR6, GR7, GR8, and GR9. The light-emitting groups GR1, GR2, GR3, GR4, GR5, GR6, GR7, GR8, and GR9 may be disposed in a matrix shape. Each light-emitting group may include a red LED R1, R2, R3, R4, R5, R6, R7, R8, or R9, a green LED G1, G2, G3, G4, G5, G6, G7, G8, or G9, and a blue LED B1, B2, B3, B4, B5, B6, B7, B8, or B9. For example, the first light-emitting group GR1 may include a red LED R1, a green LED G1, and a blue LED B1. Here, each light-emitting group may be individually controlled by the light-emitting control part 214*c* and individually activated to emit light.

A first output terminal O1 of the red LED-driving element CON1 is connected to a first terminal of each red LED R1, R2, R3, R4, R5, R6, R7, R8, and R9. A first feedback terminal F1 of the red LED-driving element CON1 is connected to a second terminal of one red LED R1, R2, R3, R4, R5, R6, R7, R8, or R9. For example, the first feedback terminal F1 may be connected to the second terminal of a third red LED R3. Thus, the red LED-driving element CON1 may feedback-control the nine red LEDs R1, R2, R3, R4, R5, R6, R7, R8, and R9 based on a received feedback current from the third red LED R3.

A second output terminal O2 of the green LED-driving element CON2 is connected to a first terminal of each green LED G1, G2, G3, G4, G5, G6, G7, G8, and G9. A second feedback terminal F2 of the green LED-driving element CON2 is connected to a second terminal of one green LED G1, G2, G3, G4, G5, G6, G7, G8, or G9. For example, the second feedback terminal F2 may be connected to the second terminal of a sixth green LED G6. Thus, the green LED-driving element CON2 may feedback-control the nine green LEDs G1, G2, G3, G4, G5, G6, G7, G8, and G9 based on a received feedback current from the sixth green LED G6.

A third output terminal O3 of the blue LED-driving element CON3 is connected to a first terminal of each blue LED B1, B2, B3, B4, B5, B6, B7, B8, and B9. A third feedback terminal F3 of the blue LED-driving element CON3 is connected to a second terminal of one blue LED B1, B2, B3, B4, B5, B6, B7, B8, or B9. For example, the third feedback terminal F3 may be connected to the second terminal of a ninth blue LED B9. Thus, the blue LED-driving element CON3 may feedback-control the nine blue LEDs B1, B2, B3, B4, B5, B6, B7, B8, and B9 based on a received feedback current from the ninth blue LED B9.

A first voltage terminal V1 of the red LED-driving element CON1, a second voltage terminal V2 of the green LED-driving element CON2, and a third voltage terminal V3 of the blue LED-driving element CON3 are connected to an external driving voltage part VCC to receive a driving voltage. The external driving voltage part VCC may be the voltage line of the driving substrate 212 described above. A first ground terminal N1 of the red LED-driving element CON1, a second ground terminal N2 of the green LED-driving element CON2, and a third ground terminal N3 of the blue LED-driving element CON3 are connected to an external ground so as to be grounded.

The light-emitting control part 214*c* includes nine light-emitting control transistors TR1, TR2, TR3, TR4, TR5, TR6, TR7, TR8, and TR9 to individually control the nine light-emitting groups GR1, GR2, GR3, GR4, GR5, GR6, GR7, GR8, and GR9, respectively.

The source electrode of each light-emitting control transistor TR1, TR2, TR3, TR4, TR5, TR6, TR7, TR8, and TR9 is connected to a light-emitting group GR1, GR2, GR3, GR4, GR5, GR6, GR7, GR8, and GR9, respectively. The drain electrode of each light-emitting control transistor TR1, TR2, TR3, TR4, TR5, TR6, TR7, TR8, and TR9 is connected to the ground portion. The gate electrode of each light-emitting control transistor TR1, TR2, TR3, TR4, TR5, TR6, TR7, TR8, and TR9 is connected to a gate control terminal L1, L2, L3, L4, L5, L6, L7, L8, and L9, respectively.

For example, a source electrode of the first light-emitting control transistor TR1 is connected to a second terminal of the first red LED R1, a second terminal of the first green LED G1, and a second terminal of the first blue LED B1. A drain electrode of the first light-emitting control transistor TR1 is connected to the ground portion. A gate electrode of the first light-emitting control transistor TR1 is connected to the first gate control terminal L1.

Therefore, the first red LED R1, the first green LED G1, and the first blue LED B1 of the first light-emitting group GR1 are simultaneously activated when a gate control signal is applied to the gate electrode of the first light-emitting control transistor TR1 through the first gate control terminal L1 to turn on the first light-emitting control transistor TR1.

A light-emitting resistor RE may be disposed between the LEDs of each light-emitting group GR1, GR2, GR3, GR4, GR5, GR6, GR7, GR8, and GR and the source electrode of each light-emitting control transistor TR1, TR2, TR3, TR4, TR5, TR6, TR7, TR8, and TR9. Specifically, a first terminal of a first light-emitting resistor RE is connected to a second terminal of the first red LED R1, and the second terminal of the first light-emitting resistor RE is connected to a source terminal of the first light-emitting control transistor TR1. A first terminal of a second light-emitting resistor RE is connected to a second terminal of the first green LED G1, and the second terminal of the second light-emitting resistor RE is connected to a source terminal of the first light-emitting control transistor TR1. A first terminal of a third light-emitting resistor RE is connected to a second terminal of the first blue LED B1, and the second terminal of the third light-emitting resistor RE is connected to a source terminal of the first light-emitting control transistor TR1. Therefore, there may be three light-emitting resistors RE in the first light-emitting group GR1.

As described above, each light-emitting control transistor TR1, TR2, TR3, TR4, TR5, TR6, TR7, TR8, and TR9 is connected to a corresponding light-emitting group GR1, GR2, GR3, GR4, GR5, GR6, GR7, GR8, and GR9, thereby individually activating the light-emitting groups GR1, GR2, GR3, GR4, GR5, GR6, GR7, GR8, and GR9 to emit light. That is, the backlight assembly 200 of the present exemplary embodiment may be driven using a local dimming method that activates fewer than all the light-emitting groups GR1, GR2, GR3, GR4, GR5, GR6, GR7, GR8, and GR9 to emit light.

Therefore, each light-emitting group GR1, GR2, GR3, GR4, GR5, GR6, GR7, GR8, and GR9 may be activated at different times, and the duration that each light-emitting group GR1, GR2, GR3, GR4, GR5, GR6, GR7, GR8, and GR9 is activated to emit light may be different.

Figure 6:
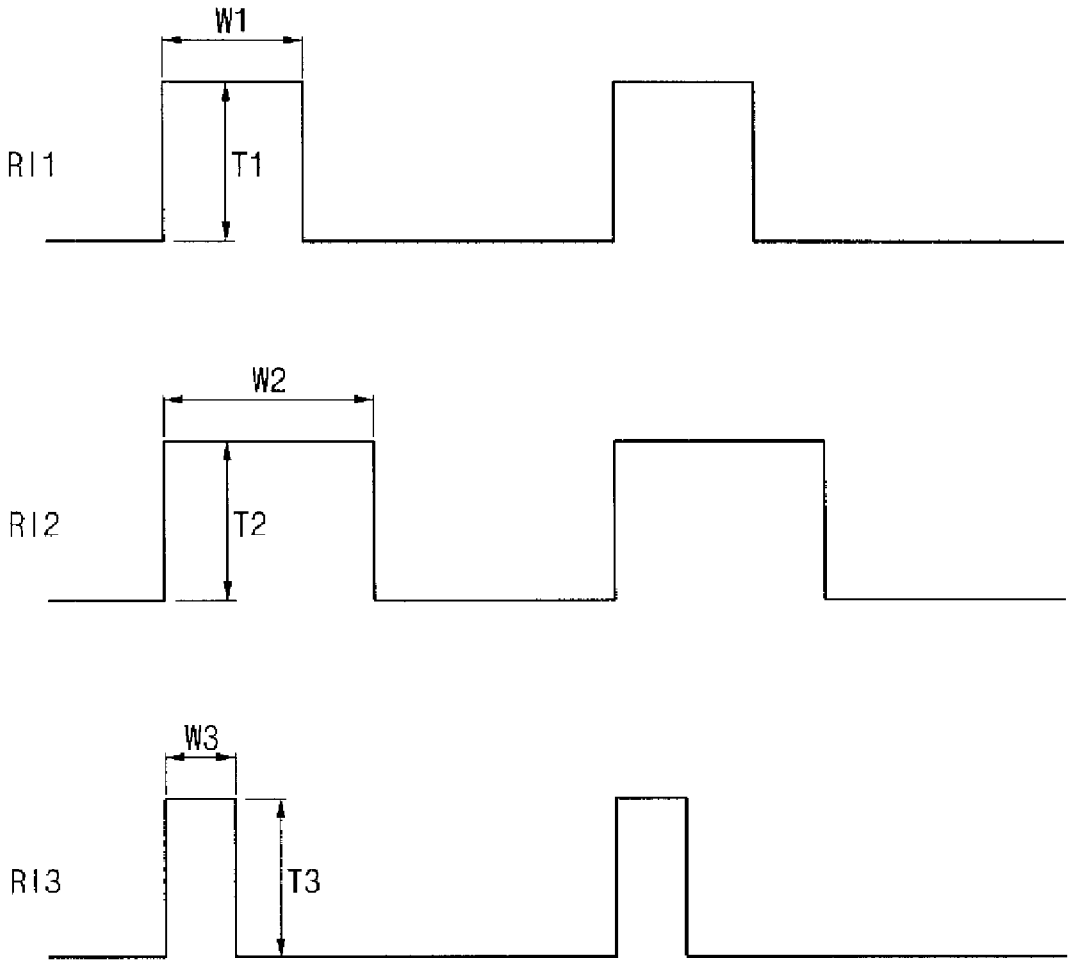
FIG. 6 is a waveform diagram illustrating current values applied to LEDs in a unit block shown in FIG. 4.

FIG. 6 is a waveform diagram illustrating current values applied to LEDs in a unit block shown in FIG. 4. In FIG. 6, only the first red LED R1, the second red LED R2, and the third red LED R3 are shown for ease of understanding.

Referring to FIG. 6, a first current R11 having a first amplitude T1 maintained for a first time interval W1 is applied to the first red LED R1. A second current R12 having a second amplitude T2 maintained for a second time interval W2 is applied to the second red LED R2. A third current R13 having a third amplitude T3 maintained for a third time interval W3 is applied to the third red LED R3. Here, the first time interval W1, the second time interval W2, and the third time interval W3 may be different from each another. For example, the first amplitude T1, the second amplitude T2, and the third amplitude T3 may be substantially equal. Alternatively, the first amplitude T1, the second amplitude T2, and the third amplitude T3 may be different from each other.

Accordingly, time intervals for applying currents corresponding to the red LEDs R1, R2, R3, R4, R5, R6, R7, R8, and R9 may be different from each other. However, peak values of the current applied to the red LEDs R1, R2, R3, R4, R5, R6, R7, R8, and R9 may be substantially equal. This relationship is similar for currents applied to the green LEDs G1, G2, G3, G4, G5, G6, G7, G8, and G9, and for the currents applied to the blue LEDs B1, B2, B3, B4, B5, B6, B7, B8, and B9.

Therefore, the red LED-driving element CON1 selectively receives a peak current from one of the red LEDs R1, R2, R3, R4, R5, R6, R7, R8, or R9, thereby feedback-controlling the red LEDs R1, R2, R3, R4, R5, R6, R7, R8, and R9.

Similarly, the green LED-driving element CON2 selectively receives a peak current from one of the green LEDs G1, G2, G3, G4, G5, G6, G7, G8, or G9, thereby feedback-controlling the green LEDs G1, G2, G3, G4, G5, G6, G7, G8, and G9, and the blue LED-driving element CON3 selectively receives a peak current from one of the blue LEDs B1, B2, B3, B4, B5, B6, B7, B8, or B9, thereby feedback-controlling the blue LEDs B1, B2, B3, B4, B5, B6, B7, B8, and B9.

Figure 7:
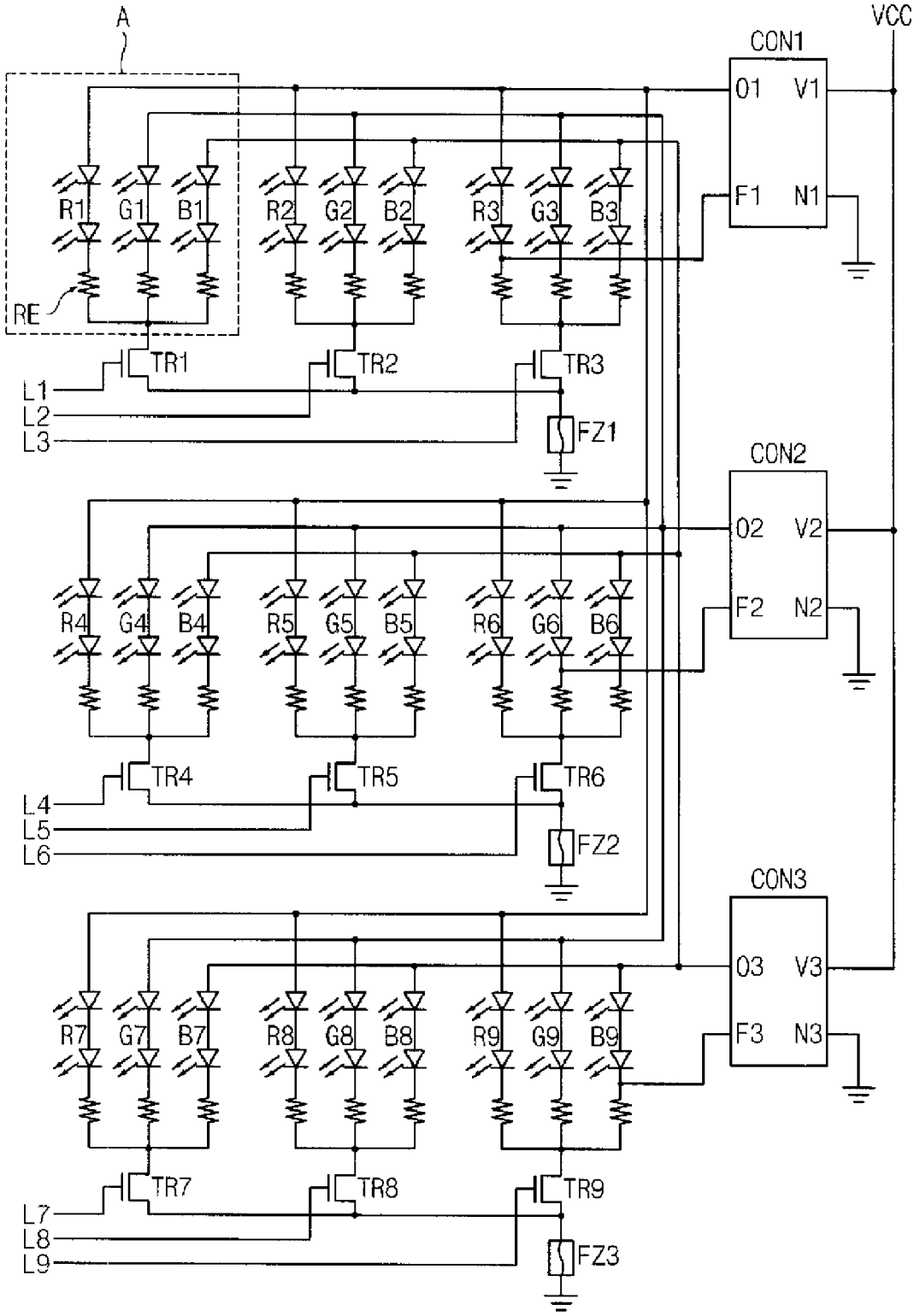
FIG. 7 is a schematic circuit diagram of the unit block shown in FIG. 3 according to another exemplary embodiment of the present invention.
Figure 8:
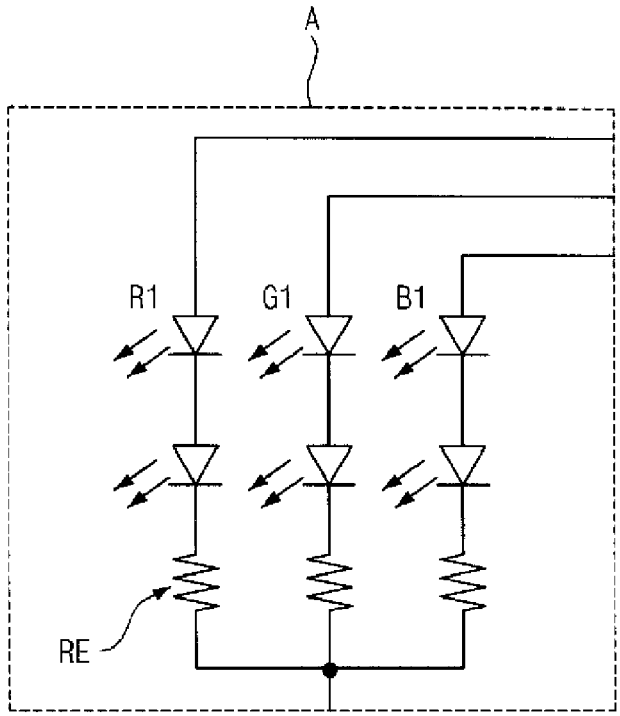
FIG. 8 is an enlarged circuit diagram of block "A" shown in FIG. 7.
Figure 9:
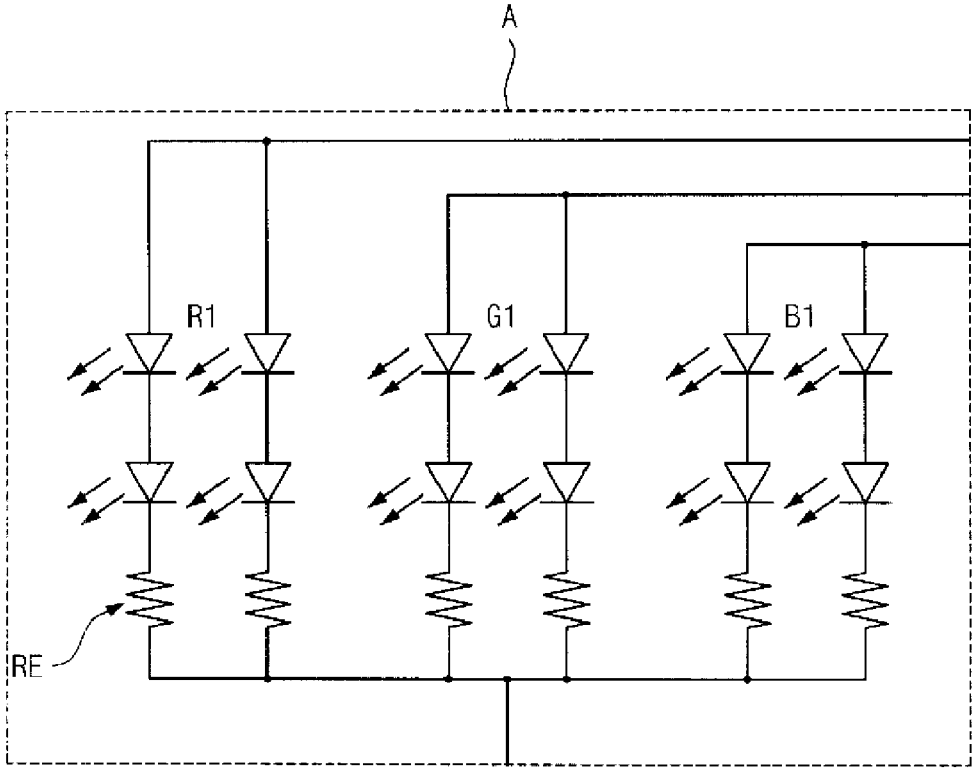
FIG. 9 is an enlarged circuit diagram of block "A" shown in FIG. 7 according to another exemplary embodiment of the present invention.

FIG. 7 is a schematic circuit diagram of the unit block shown in FIG. 3 according to another exemplary embodiment of the present invention. FIG. 8 is an enlarged circuit diagram of block "A" shown in FIG. 7. FIG. 9 is an enlarged circuit diagram of block "A" shown in FIG. 7 according to another exemplary embodiment of the present invention.

Referring to FIG. 7, FIG. 8, and FIG. 9, each light-emitting group GR1, GR2, GR3, GR4, GR5, GR6, GR7, GR8, and GR9 may include at least two red LEDs, at least two green LEDs, and at least two blue LEDs.

Within each light-emitting group GR1, GR2, GR3, GR4, GR5, GR6, GR7, GR8, and GR9, the red LEDs may be connected in series or in parallel with each other, the green LEDs may be connected in series or in parallel with each other, and the blue LEDs may be connected in series or in parallel with each other.

For example, referring to FIG. 8, each light-emitting group GR1, GR2, GR3, GR4, GR5, GR6, GR7, GR8, and GR9 may include two red LEDs, two green LEDs, and two blue LEDs. Here, the red LEDs are connected in series with each other, the green LEDs are connected in series with each other, and the blue LEDs are connected in series with each other.

For another example, referring to FIG. 9, each light-emitting group GR1, GR2, GR3, GR4, GR5, GR6, GR7, GR8, and GR9 may include four red LEDs, four green LEDs, and four blue LEDs. Here, a first group of two red LEDs are connected in series, another group of two red LEDs are connected in series, and the two groups of two red LEDs are connected in parallel. Similarly, a group of two green LEDs are connected in series, another group of two green LEDs are connected in series, and the two groups of two green LEDs are connected in parallel. A group of two blue LEDs are connected in series, another group of two blue LEDs are connected in series, and the two groups of two blue LEDs are connected in parallel.

Accordingly, the red LEDs, the green LEDs, and the blue LEDs of the same light-emitting group may be connected in series and/or in parallel with one another, respectively.

Additionally, each unit block BL may include an over-current prevention part to prevent an over-current from flowing into the light-emitting part 214*a*.

For example, the over-current prevention part may include fuses FZ1, FZ2 and FZ3 that are connected to the light-emitting groups GR1, GR2, GR3, GR4, GR5, GR6, GR7, GR8, and GR9.

Specifically, a first terminal of a first fuse FZ1 is connected to the drain electrode of the first light-emitting control transistor TR1, the drain electrode of the second light-emitting control transistor TR2, and the drain electrode of the third light-emitting control transistor TR3. The second terminal of the first fuse FZ1 is connected to an external ground. A first terminal of a second fuse FZ2 is connected to the drain electrode of the fourth light-emitting control transistor TR4, the drain electrode of the fifth light-emitting control transistor TR5, and the drain electrode of the sixth light-emitting control transistor TR6. The second terminal of the second fuse FZ2 is connected to an external ground. A first terminal of a third fuse FZ3 is connected to the drain electrode of the seventh light-emitting control transistor TR7, the drain electrode of the eighth light-emitting control transistor TR8, and the drain electrode of the ninth light-emitting transistor TR9. The second terminal of the third fuse FZ3 is connected to an external ground.

Alternatively, the over-current prevention part may be disposed in an area that is different from the area shown in FIG. 7 to prevent an over-current from flowing to the light-emitting groups GR1, GR2, GR3, GR4, GR5, GR6, GR7, GR8, and GR9.

Thus, according to the present exemplary embodiment, one driving element may drive a plurality of LEDs. For example, the driving part 214*b* in a unit block BL includes red LED-driving element CON1 to drive a plurality of red LEDs R1, R2, R3, R4, R5, R6, R7, R8, and R9. Accordingly, a number of driving elements used to form a backlight assembly may be reduced.

Exemplary Embodiment 2

Display Device

Figure 10:
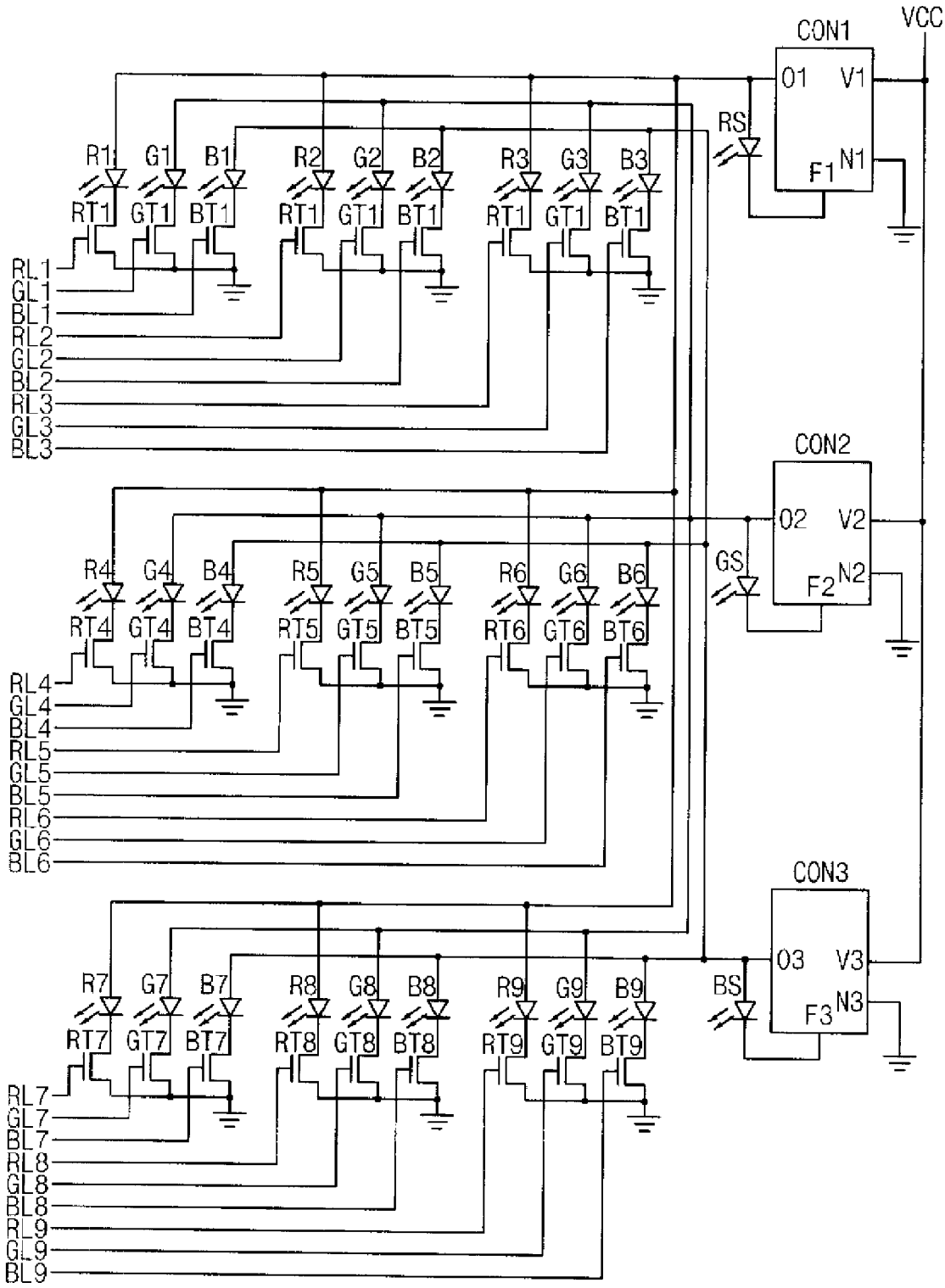
FIG. 10 is a schematic circuit diagram illustrating a unit block of a display device backlight assembly according to another exemplary embodiment of the present invention.

FIG. 10 is a schematic circuit diagram illustrating a unit block of a display device backlight assembly according to another exemplary embodiment of the present invention.

The display device 400 in this exemplary embodiment is substantially similar as the display device 400 in the previous exemplary embodiment except for a light-emitting unit 214. Thus, same reference numerals will be used to refer to the same or substantially similar components as those components described in a previous exemplary embodiment except for a light-emitting unit 214, and any further explanations concerning the above elements will be omitted.

Referring to FIG. 1, FIG. 3, FIG. 5 and FIG. 10, a light-emitting unit 214 of the present exemplary embodiment is disposed on the driving substrate 212, and is divided into unit blocks BL. Each unit block BL includes a light-emitting part 214*a* that emits light, a driving part 214*b* that provides the light-emitting part 214*a* with a driving voltage, and a light-emitting control part 214*c* that controls the light-emitting part 214*a*.

The light-emitting part 214*a* includes at least two red LEDs, at least two green LEDs, and at least two blue LEDs.

As shown in FIG. 10, the driving part 214*b* includes a red LED-driving element CON1 that provides the red LEDs with a driving voltage, a green LED-driving element CON2 that provides the green LEDs with the driving voltage, and a blue LED-driving element CON3 that provides the blue LEDs with the driving voltage.

The light-emitting control part 214*c* is connected to the light-emitting part 214*a*, and controls the red LEDs, the green LEDs and the blue LEDs so that they may be individually activated to emit light.

In particular, the light-emitting part 214*a* includes nine red LEDs R1, R2, R3, R4, R5, R6, R7, R8, and R9, nine green LEDs G1, G2, G3, G4, G5, G6, G7, G8, and G9, and nine blue LEDs B1, B2, B3, B4, B5, B6, B7, B8, and B9.

The light-emitting part 214*a* is divided into nine light-emitting groups GR1, GR2, GR3, GR4, GR5, GR6, GR7, GR8, and GR9. Each light-emitting group GR1, GR2, GR3, GR4, GR5, GR6, GR7, GR8, and GR9 includes one of the nine red LEDs R1, R2, R3, R4, R5, R6, R7, R8, and R9, one of the nine green LEDs G1, G2, G3, G4, G5, G6, G7, G8, and G9, and one of the nine blue LEDs B1, B2, B3, B4, B5, B6, B7, B8, and B9.

A first output terminal O1 of the red LED-driving element CON1 is connected to a first terminal of each red LED R1, R2, R3, R4, R5, R6, R7, R8, and R9. A second output terminal O2 of the green LED-driving element CON2 is connected to a first terminal of each green LED G1, G2, G3, G4, G5, G6, G7, G8, and G9. A third output terminal O3 of the blue LED-driving element CON3 is connected to a first terminal of each blue LED B1, B2, B3, B4, B5, B6, B7, B8, and B9.

A first voltage terminal V1 of the red LED-driving element CON1, a second voltage terminal V2 of the green LED-driving element CON2, and a third voltage terminal V3 of the blue LED-driving element CON3 are connected to an external driving voltage part VCC to receive the driving voltage. A first ground terminal N1 of the red LED-driving element CON1, a second ground terminal N2 of the green LED-driving element CON2, and a third ground terminal N3 of the blue LED-driving element CON3 are connected to an external ground to be grounded.

The light-emitting part 214*a* of the present exemplary embodiment may further include a first sample LED RS, a second sample LED GS, and a third sample LED BS.

The first sample LED RS is a red LED that may be substantially the same as the nine red LEDs R1, R2, R3, R4, R5, R6, R7, R8, and R9. A first terminal of the first sample LED RS is connected to a first output terminal O1 of the red LED-driving element CON1, and a second terminal of the first sample LED RS is connected to a first feed-back terminal F1 of the red LED-driving element CON1. Thus, the first sample LED RS provides the red LED-driving element CON1 with a first sample current as a feedback current to control the nine red LEDs R1, R2, R3, R4, R5, R6, R7, R8, and R9.

The second sample LED GS is a green LED that may be substantially the same as the nine green LEDs G1, G2, G3, G4, G5, G6, G7, G8, and G9. A first terminal of the second sample LED GS is connected to a second output terminal O2 of the green LED-driving element CON2, and a second terminal of the second sample LED GS is connected to a second feed-back terminal F2 of the green LED-driving element CON2. Thus, the second sample LED GS provides the green LED-driving element CON2 with a second sample current as a feedback current to control the nine green LEDs G1, G2, G3, G4, G5, G6, G7, G8, and G9.

The third sample LED BS is a blue LED that may be substantially the same as the nine blue LEDs B1, B2, B3, B4, B5, B6, B7, B8, and B9. A first terminal of the third sample LED BS is connected to a third output terminal O3 of the blue LED-driving element CON3, and a second terminal of the third sample LED BS is connected to a third feed-back terminal F3 of the blue LED-driving element CON3. Thus, the third sample LED BS provides the blue LED-driving element CON3 with a third sample current as a feedback current to control the nine blue LEDs B1, B2, B3, B4, B5, B6, B7, B8, and B9.

The light-emitting control part 214*c* includes nine red light-emitting control transistors RT1, RT2, RT3, RT4, RT5, RT6, RT7, RT8 and RT9, nine green light-emitting control transistors GT1, GT2, GT3, GT4, GT5, GT6, GT7, GT8 and GT9, and nine blue light-emitting control transistors BT1, BT2, BT3, BT4, BT5, BT6, BT7, BT8 and BT9.

The nine red light-emitting control transistors RT1, RT2, RT3, RT4, RT5, RT6, RT7, RT8 and RT9 individually and respectively control the nine red LEDs R1, R2, R3, R4, R5, R6, R7, R8, and R9. The nine green light-emitting control transistors GT1, GT2, GT3, GT4, GT5, GT6, GT7, GT8 and GT9 individually and respectively control the nine green LEDs G1, G2, G3, G4, G5, G6, G7, G8, and G9. The nine blue light-emitting control transistors BT1, BT2, BT3, BT4, BT5, BT6, BT7, BT8 and BT9 individually and respectively control the nine blue LEDs B1, B2, B3, B4, B5, B6, B7, B8, and B9.

In particular, the source electrode of each red light-emitting control transistor RT1, RT2, RT3, RT4, RT5, RT6, RT7, RT8 and RT9 is connected to a second terminal of a corresponding red LED R1, R2, R3, R4, R5, R6, R7, R8, and R9. The source electrode of each green light-emitting control transistor GT1, GT2, GT3, GT4, GT5, GT6, GT7, GT8 and GT9 is connected to a second terminal of a corresponding green LED G1, G2, G3, G4, G5, G6, G7, G8, and G9. The source electrode of each blue light-emitting control transistor BT1, BT2, BT3, BT4, BT5, BT6, BT7, BT8 and BT9 is connected to a second terminal of a corresponding blue LED B1, B2, B3, B4, B5, B6, B7, B8, and B9.

Drain electrodes of the red light-emitting control transistors RT1, RT2, RT3, RT4, RT5, RT6, RT7, RT8 and RT9, drain electrodes of the green light-emitting control transistors GT1, GT2, GT3, GT4, GT5, GT6, GT7, GT8 and GT9, and drain electrodes of the blue light-emitting control transistors BT1, BT2, BT3, BT4, BT5, BT6, BT7, BT8 and BT9 are connected to the external ground to be grounded.

The gate electrode of each red light-emitting control transistor RT1, RT2, RT3, RT4, RT5, RT6, RT7, RT8 and RT9 is connected to a corresponding red control terminal RL1, RL2, RL3, RL4, RL5, RL6, RL7, RL8, and RL9. The gate electrode of each green light-emitting control transistor GT1, GT2, GT3, GT4, GT5, GT6, GT7, GT8 and GT9 is connected to a corresponding green control terminal GL1, GL2, GL3, GL4, GL5, GL6, GL7, GL8, and GL9. The gate electrode of each blue light-emitting control transistor BT1, BT2, BT3, BT4, BT5, BT6, BT7, BT8 and BT9 is connected to a corresponding blue control terminal BL1, BL2, BL3, BL4, BL5, BL6, BL7, BL8, and BL9.

A light-emitting resistor (not shown) may be disposed between each red LED R1, R2, R3, R4, R5, R6, R7, R8, and R9 and a corresponding red light-emitting control transistor RT1, RT2, RT3, RT4, RT5, RT6, RT7, RT8 and RT9. A light-emitting resistor (not shown) may be disposed between each green LED G1, G2, G3, G4, G5, G6, G7, G8, and G9 and a corresponding green light-emitting control transistor GT1, GT2, GT3, GT4, GT5, GT6, GT7, GT8 and GT9. A light-emitting resistor (not shown) may be disposed between each blue LED B1, B2, B3, B4, B5, B6, B7, B8, and B9 and a corresponding blue light-emitting control transistors BT1, BT2, BT3, BT4, BT5, BT6, BT7, BT8 and BT9.

Accordingly, each red light-emitting control transistor RT1, RT2, RT3, RT4, RT5, RT6, RT7, RT8 and RT9 is connected to a corresponding red LED R1, R2, R3, R4, R5, R6, R7, R8, and R9 so that the nine red LEDs R1, R2, R3, R4, R5, R6, R7, R8, and R9 may be individually controlled. Each green light-emitting control transistor GT1, GT2, GT3, GT4, GT5, GT6, GT7, GT8 and GT9 is connected to a corresponding green LED G1, G2, G3, G4, G5, G6, G7, G8, and G9 so that the nine green LEDs G1, G2, G3, G4, G5, G6, G7, G8, and G9 may be individually controlled. Each blue light-emitting control transistor BT1, BT2, BT3, BT4, BT5, BT6, BT7, BT8 and BT9 is connected to a corresponding blue LED B1, B2, B3, B4, B5, B6, B7, B8, and B9 so that the nine blue LEDs B1, B2, B3, B4, B5, B6, B7, B8, and B9 may be individually controlled.

That is, the backlight assembly 200 according to the present exemplary embodiment may be driven by a field sequential driving method so a red color light, a green color light and a blue color light are sequentially emitted. In other words, the red light-emitting control transistors RT1, RT2, RT3, RT4, RT5, RT6, RT7, RT8 and RT9, the green light-emitting control transistors GT1, GT2, GT3, GT4, GT5, GT6, GT7, GT8 and GT9, and the blue light-emitting control transistors BT1, BT2, BT3, BT4, BT5, BT6, BT7, BT8 and BT9 may be sequentially activated to emit the red color light, the green color light, and the blue color light, respectively.

When the backlight assembly 200 is driven by the field sequential driving method to sequentially emit the red color light, the green color light, and the blue color light, color filters may be omitted from the second substrate 120 of the display panel assembly 100.

According to the present invention, a driving element may simultaneously drive a plurality of LEDs, and thus a number of driving elements used to form a backlight assembly may be decreased. Furthermore, a circuit for a backlight assembly may be simplified so that manufacturing costs of the backlight assembly may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A backlight assembly comprising a plurality of unit blocks to emit light, wherein each unit block comprises:

a light-emitting part comprising two red light-emitting diodes (LEDs), two green LEDs and two blue LEDs; and a driving part comprising a red LED-driving element to provide the two red LEDs with a driving voltage, a green LED-driving element to provide the two green LEDs with the driving voltage, and a blue LED-driving element to provide the two blue LEDs with the driving voltage, wherein the two red LEDs are connected in parallel with each other, the two green LEDs are connected in parallel with each other, and the two blue LEDs are connected in parallel with each other.

2. The backlight assembly of claim 1, wherein the red LED-driving element receives a feedback current from one of the two red LEDs to control the two red LEDs, the green LED-driving element receives a feedback current from one of the two green LEDs to control the two green LEDs, and the blue LED-driving element receives a feedback current from one of the two blue LEDs to control the two blue LEDs.

3. The backlight assembly of claim 2, wherein the feedback current from one of the two red LEDs is a red LED peak current, the feedback current from one of the two green LEDs is a green LED peak current, and the feedback current from one of the two blue LEDs is a blue LED peak current.

4. The backlight assembly of claim 2, wherein the light-emitting part comprises a first light-emitting group and a second light-emitting group, the first light-emitting group comprises a first red LED of the two red LEDs, a first green LED of the two green LEDs, and a first blue LED of the two blue LEDs, and the second light-emitting group comprises a second red LED of the two red LEDs, a second green LED of the two green LEDs, and a second blue LED of the two blue LEDs.

5. The backlight assembly of claim 4, wherein the first light-emitting group and the second light emitting group emit light separately.

6. The backlight assembly of claim 5, wherein each unit block further comprises:

a light-emitting control part connected to the first light-emitting group and the second light emitting group to individually control the first light-emitting group and the second light emitting group to emit light separately.

7. The backlight assembly of claim 6, wherein the light-emitting control part comprises:

a first light-emitting control transistor connected to the first light-emitting group; and a second light-emitting control transistor connected to the second light-emitting group.

8. The backlight assembly of claim 5, wherein each unit block further comprises:

an over-current prevention part to prevent an over-current in the light-emitting part.

9. The backlight assembly of claim 8, wherein the over-current prevention part comprises:

a first fuse connected to the first light-emitting group; and a second fuse connected to the second light-emitting group.

10. The backlight assembly of claim 5, wherein the first light-emitting group further comprises a third red LED connected in series or in parallel with the first red LED, a third green LED connected in series or in parallel with the first green LED, and a third blue LED connected in series or in parallel with the first blue LED.

11. The backlight assembly of claim 1, wherein each unit block further comprises:

a light-emitting control part connected to the light-emitting part, the light-emitting control part to individually control the two red LEDs, the two green LEDs, and the two blue LEDs.

12. The backlight assembly of claim 11, wherein the light-emitting control part comprises:

a first light-emitting control transistor connected to a first red LED of the two red LEDs;

a second light-emitting control transistor connected to a first green LED of the two green LEDs;

a third light-emitting control transistor connected to a first blue LED of the two blue LEDs;

a fourth light-emitting control transistor connected to a second red LED of the two red LEDs;

a fifth light-emitting control transistor connected to a second green LED of the two green LEDs; and a sixth light-emitting control transistor connected to a second blue LED of the two blue LEDs.

13. The backlight assembly of claim 12, wherein the two red LEDs, the two green LEDs, and the two blue LEDs are sequentially activated to emit light.

14. The backlight assembly of claim 11, wherein the light-emitting part further comprises:

a first sample LED to provide the red LED-driving element with a first sample current as a feedback current to control the two red LEDs;

a second sample LED to provide the green LED-driving element with a second sample current as a feedback current as to control the two green LEDs; and a third sample LED to provide the blue LED-driving element with a third sample current as a feedback current to control the two blue LEDs.

15. A display device, comprising:

a backlight assembly comprising a plurality of unit blocks to emit light; and a display panel disposed on the backlight assembly to display an image, wherein each unit block comprises:

a light-emitting part comprising two red light-emitting diodes (LEDs), two green LEDs, and two blue LEDs; and a driving part comprising a red LED-driving element to provide the two red LEDs with a driving voltage, a green LED-driving element to provide the two green LEDs with the driving voltage, and a blue LED-driving element to provide the two blue LEDs with the driving voltage, wherein the two red LEDs are connected in parallel with each other, the two green LEDs are connected in parallel with each other, and the two blue LEDs are connected in parallel with each other.

16. The display device of claim 15, further comprising:

a control unit connected to the backlight assembly and connected to the display panel to simultaneously control the backlight assembly and the display panel.

17. A backlight assembly comprising a plurality of unit blocks to emit light, wherein each unit block comprises:

a light-emitting part comprising:

a first light-emitting group comprising a first red light-emitting diode (LED), a first green LED, and a first blue LED;

a second light-emitting group comprising a second red LED, a second green LED, and a second blue LED; and a third light-emitting group comprising a third red LED, a third green LED, and a third blue LED;

a driving part comprising:

a red LED-driving element connected to the first red LED, the second red LED, and the third red LED;

a green LED-driving element connected to the first green LED, the second green LED, and the third green LED; and a blue LED-driving element connected to the first blue LED, the second blue LED, and the third blue LED; and a light-emitting control part comprising:

a first light-emitting control transistor connected to the first light-emitting group to individually control the first light-emitting group;

a second light-emitting control transistor connected to the second light-emitting group to individually control the second light emitting group; and a third light-emitting control transistor connected to the third light-emitting group to individually control the third light emitting group.

18. The backlight assembly of claim 17, further comprising:

a first light-emitting resistor connected to the first red LED and the first light-emitting control transistor;

a second light-emitting resistor connected to the second green LED and the second light-emitting control transistor; and a third light-emitting resistor connected to the third blue LED and the third light-emitting control transistor.

19. The backlight assembly of claim 18, wherein a resistance of the first light-emitting resistor, a resistance of the second light-emitting resistor, and a resistance of the third light-emitting resistor are equal.

20. The backlight assembly of claim 18, wherein a resistance of the first light-emitting resistor, a resistance of the second light-emitting resistor, and a resistance of the third light-emitting resistor are not equal.

* * * * *